United States Patent [19]

Kneebone et al.

[11] Patent Number: 4,961,387

[45] Date of Patent: Oct. 9, 1990

[54] UNIVERSALLY ADAPTABLE, HINGED HATCH COVER SYSTEM FOR RAILROAD HOPPER CARS

[76] Inventors: Ken L. Kneebone; James E. Head, both of R. R. 2, Neodesha, Kans. 66757

[21] Appl. No.: 263,706

[22] Filed: Oct. 28, 1988

[51] Int. Cl.[5] ..... B61D 39/00; E05D 7/04

[52] U.S. Cl. ..... 105/377; 16/235

[58] Field of Search ..... 105/377, 308.1, 310; 220/334, 1 T, 1 V, 1.5, 342, 343; 16/233–237, 248, 247; 49/52, 402

[56] References Cited

U.S. PATENT DOCUMENTS

| | | | |
|---|---|---|---|
| 4,239,008 | 12/1980 | Conlon | 105/377 |
| 4,650,089 | 3/1987 | Sanders | 220/334 |
| 4,796,538 | 1/1989 | McLean, Jr. et al. | 105/377 |

*Primary Examiner*—Robert J. Oberleitner

*Attorney, Agent, or Firm*—Hovey, Williams, Timmons & Collins

[57] ABSTRACT

A cover assembly is used with any one of a plurality of hopper cars each including a top side having a trough hatch therein, coaming extending around the perimeter of the trough hatch, and hinge pin brackets attached to the top side of the hopper car at one of a plurality of predetermined vertical heights relative to an upper edge of the coaming. The cover assembly permits the hatch cover to be fastened to hopper cars having hinge pin brackets provided with pin axes located at one of the plurality of heights relative to the upper edge of the coaming, and includes a hatch cover and a universal hinging system for use therewith. The hinging system includes a bracket and a plurality of hinge eye plates. Each of the plurality of hinge eye plates includes a bracket connection surface defined in a plane and an eye segment defining a opening having a central axis. The central axis of each of the plurality of hinge eye plates is displaced from the plane of the hinge eye plate by a distance different from the distance between the central axis and plane of each of the other hinge eye plates. The bracket is connectable with the cover as well as with the bracket connection surface of one of the hinge eye plates, and the hinge eye plate is connectable with hinge pin bracket with the central axis of the eye segment aligned with the pivot axis defined by the hinge pin bracket of the hopper car.

11 Claims, 1 Drawing Sheet

Fig.1.
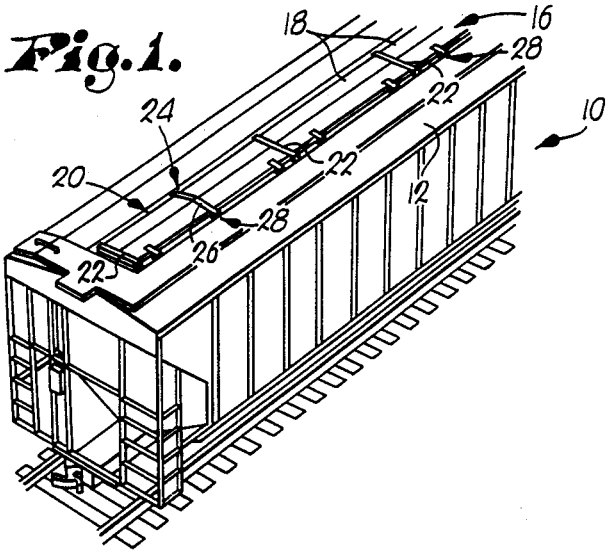
Fig.3.
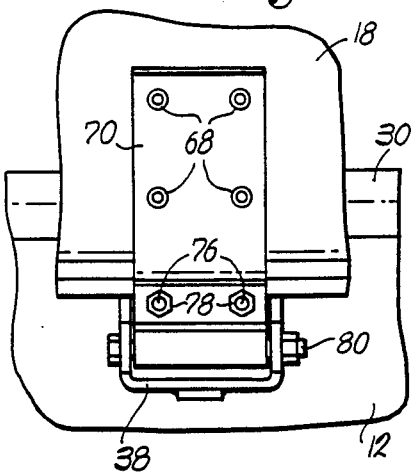
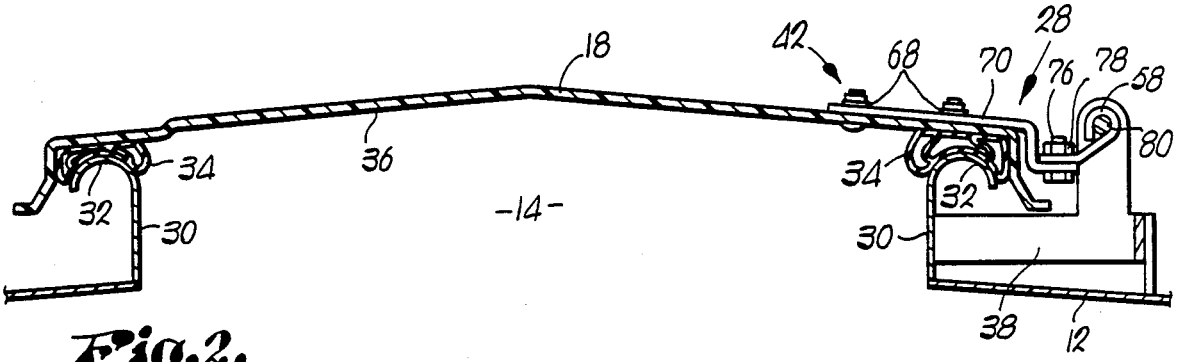
Fig.2.
Fig.4.
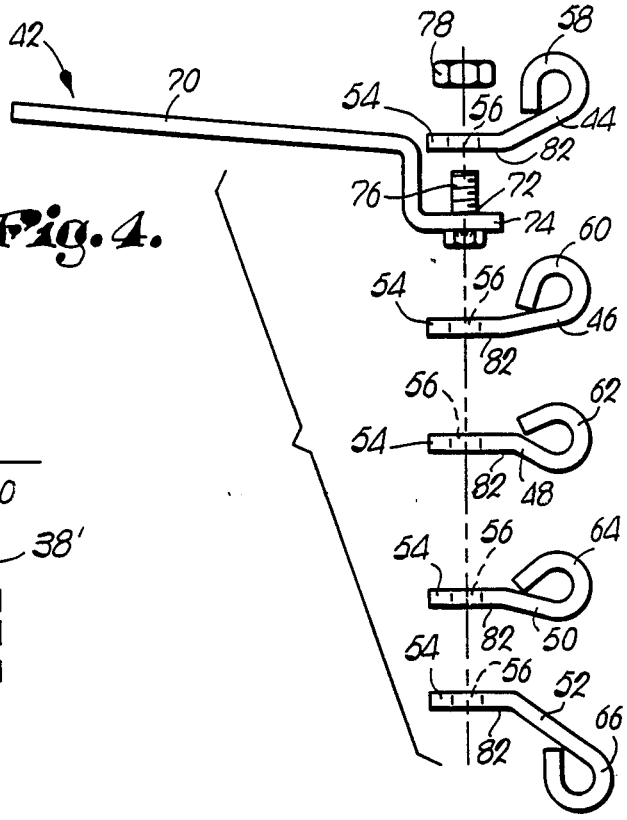
Fig.5.
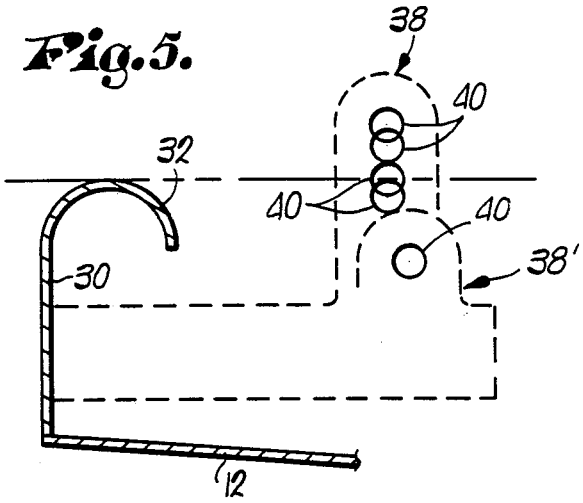

UNIVERSALLY ADAPTABLE, HINGED HATCH COVER SYSTEM FOR RAILROAD HOPPER CARS

BACKGROUND OF THE INVENTION

1. Field of the Invention

The present invention relates generally to hinging systems and, more particularly, to a hinging system and cover assembly for a railroad hopper car which permits each cover to be used with any of a plurality of different hopper car constructions.

2. Discussion of the Prior Art

Since the inception of the covered hopper car in the 1920's, the different manufacturers of railroad hopper cars have made numerous hopper car designs having different lengths and types of hatch openings each requiring a specific hatch cover construction, making it impossible to define a hatch cover having a standard length or hinge type. For example, different trough hatch lengths, widths, and hinge pin to coaming distances, as well as different hinge pin diameters, and different latching systems used with the trough hatches, are among the several variables existing in hatch covers used with known hopper cars.

However, known trough hatch arrangements generally fall into two broad groups; troughs having a 20" width, and troughs having a 24" width. Typically, troughs having a 24" width are designed in several lengths, two of which are more widely used than the rest. These lengths are 10'-11 11/16"and 12'-11¾". In addition, the hinge pins typically employed to connect hatch covers to the hinge pin brackets of these 24" width troughs are displaced vertically from the upper edge of the coaming of the trough hatch by one of five different distances; +13/16", +½", even, −¼"and −1¼". When a hopper car is built utilizing a 24" width and hinge pin brackets having one of the above-mentioned hinge pin-to-coaming distances, the hatch cover or covers to be used on the car are fitted with cover brackets that align the cover with the hopper car hinge pin brackets. Thus, each cover may only be used with a single hopper car arrangement, and it is necessary to provide as many different hatch cover assemblies as there are hopper car arrangements.

As an attempted solution to this problem, it has been proposed that each hinge bracket employed with a hatch cover be made reversible relative to the hatch cover so that the hinge bracket may be used to accommodate either of the five different arrangements mentioned above. Previously, however, with normal construction, it would be necessary to remove the entire hinge bracket assembly should it be determined that another size of hinge bracket is required, which can result in the need for a completely new cover assembly where, e.g. the brackets are riveted or otherwise permanently fastened to the hatch cover.

Where 20" width trough hatch arrangements are used, six lengths are commonly employed. These lengths are 7'-11¾", 8'-3⅜", 9'-6", 10'-7⅜", 12'-4⅜" and 11'-11 3/16". The 20" hatch covers are attached to the hopper cars using hinge pins that have a vertical hinge pin-to-coaming separation of either +1/16" or −1¼". Additionally, one of two different locking systems are employed with the 20" width constructions to latch the covers to the hopper cars. Each of these locking systems includes a locking mechanism unique to that system and further requires a bracket which must be incorporated in the cover assembly to mate properly with each unique locking system on the hopper car. Thus, not only must the cover itself cooperate with the hinge pin brackets of the hopper car, but the locking system must also cooperate therewith.

In view of the many different variables existent in the field of hopper car covering assemblies, it would be desirable to provide a hatch cover assembly that may be used on any of several car constructions in order to reduce the amount of inventory that a supplier must carry to satisfy the needs of the industry.

OBJECTS AND SUMMARY OF THE INVENTION

It is an object of the present invention to provide a hinging system that permits a single hatch cover assembly to be employed with any of several known hopper car designs.

A further object of the present invention is to provide a hatch cover that may be originally assembled or retrofitted to cooperate with any one of a plurality of different hopper car constructions in order to expand the adaptability of the hatch cover and to reduce the number of hatch cover assemblies necessary to meet the needs of the industry.

According to the invention, a hinging system for use in pivotally connecting a first body member to a second body member about a pivot axis defined by the second body member includes a bracket and a plurality of hinge eye plates. Each of the hinge eye plates includes a bracket connection surface defining a reference plane and an eye segment defining an opening having a central axis. The central axis of each of the plurality of hinge eye plates is displaced from the reference plane of that hinge eye plate by a distance different from the distance between the central axis and plane of each of the other hinge eye plates. Means are provided for connecting the cover bracket at the cover bracket connection surface of one of the hinge eye plates.

In another aspect of the invention, a hatch cover assembly is provided for use in hopper cars each including a top side having a trough hatch therein, coaming extending around the perimeter of the trough hatch, and at least ten hinge pin brackets attached to the top side of the hopper car and defining a pivot axis at one of a plurality of predetermined vertical heights relative to the upper edge of the coaming. This cover assembly permits the adaptation of a hatch cover to be fastened to a hopper car including hinge pin brackets disposed at a different one of the predetermined heights relative to the upper edge of the coaming.

According to this aspect of the invention, the assembly includes a hatch cover pivoted to a position covering the trough hatch and including a cover bracket fixed thereto adjacent each hinge pin bracket, and a plurality of unique attachable hinge eye plates. Each of the hinge eye plates, when attached to one of the cover brackets, is adapted to align with a hinge pin bracket located at one of the predetermined vertical heights relative to the coaming when the hatch cover is pivoted to a positon covering the car trough hatch. The plurality of unique eye plates permits attachment of the hatch cover to hopper car trough hatches having hinge pin brackets of differing vertical heights relative to the coaming of the trough hatches.

By this inventive construction, numerous advantages are realized. For example, by employing the inventive system or assembly, it is possible to stock one hatch cover for either of the 20" or 24" construction, and adapt this hatch cover to a specific application by attaching the appropriate hinge eye plate. Further, at a later date the hatch cover may be removed and properly fitted on a different car by simply changing the hinge eye plates. In addition, should new hopper car constructions be designed in the future that differ from those presently on the market, a new hinge eye plate may be easily designed to permit adaptation of an already existing cover assembly for use on the new design.

Further, where it is desirable to adapt a hatch cover for use with a locking system different from the one for which it was assembled, the present invention permits such adaptation by providing that the inventive hinging system be employed as a part of the locking assembly. For example, a latch plate may be constructed for each known locking assembly in a manner similar to the inventive hinge eye plates and can be assembled on an appropriately positioned cover bracket during assembly of the hatch cover just as are the hinges. In this manner, the hatch cover may also be employed with any of a plurality of known locking assemblies.

BRIEF DESCRIPTION OF THE DRAWING FIGURES

A preferred embodiment of the inventive hinging system is discussed below with reference to the attached drawing figures, wherein:

FIG. 1 is a partial perspective view of a hopper car employing a cover assembly constructed in accordance with the invention;

FIG. 2 is a cross-sectional end view of a cover assembly made in accordance with the invention;

FIG. 3 is a top view of a hinge made according to the present invention;

FIG. 4 is an exploded schematic view illustrating each of a plurality of hinge eye plates which may be attached to a cover bracket to facilitate different desired hinge assemblies; and FIG. 5 is a schematic view illustrating the relationship between the coaming and the various hinge pin bracket holes employed in known existing railroad hopper cars.

DETAILED DESCRIPTION OF A PREFERRED EMBODIMENT

A railroad hopper car 10 is shown in FIG. 1 to include a roof 12 having an opening or trough hatch 14 (FIG. 2), extending along substantially the entire length thereof. This trough hatch 14 is covered by a hatch cover car set assembly 16 including a number of hatch covers 18, 20. Each of the hatch covers 18, 20 extends along a portion of the trough hatch 14 and is secured to the roof 12 of the car 10 by a set of batten bars 22 and locking assemblies 24. The batten bars 22 are located at the ends of the trough hatch 14 and between each of the hatch cover assemblies 18, 20, and are typically made from metal such as steel and the like. A gasket insert (not shown) is provided on the batten bars 22 so that when the batten bars are fastened across the hatch cover assemblies 18, 20, the covers are sealed against the batten bars 22 which also seals the covers 18, 20 along the coaming 30 beneath.

The locking device 24, although not shown in detail, includes a latch of any conventional construction such as an ACF Locking Device latch produced by American Car & Foundry or an IRE Locking Device latch produced by Illinois Railway Equipment. The locking device 24 also includes a latch bracket 26 extending across the middle of the hatch cover assembly 20 and having bolt holes or the like at each end thereof, a hinging assembly of a type to be described below, and a latch plate which is attachable to one end of the cover bracket. The latch is engageable with the plate to lock the cover assembly in a closed position on the trough hatch 14.

Each hatch cover assembly 18, 20 on the car 10 also includes a number of hinge assemblies 28 that permit the hatch cover assembly 18, 20 to be pivoted between an open position in which the hopper car may be filled and closed position in which material in the car is protected for transport. The specific construction of these hinges is discussed with reference to FIGS. 2–4.

As illustrated in FIG. 2, a coaming 30 extends around the perimeter of the trough hatch 14 which protrudes from the roof 12 of the car 10 by a predetermined distance in the vertical direction. The coaming 30 is curved at the upper edge thereof to form an upper lip 32 against which a resilient gasket 34 of a hatch cover assembly 18, 20 is pressed to provide a sealing engagement between the hatch cover assembly and the trough hatch coaming 30. The gasket 34, in turn, is glued or otherwise fastened to the inside surface 36 of the cover assembly 18, 20 and remains attached to the cover when the cover is opened.

A plurality of hopper car hinge pin brackets 38 are located along one side of the trough hatch 14 and are welded to the roof 12 of the car. The brackets 38 extend upwardly from the roof 12 and include a pair of horizontally aligned hinge pin holes 40 disposed at a predetermined vertical height above the roof 12 of the car. Although only one hopper car 10 is illustrated in the figures, it is clear from the discussion above of the prior art, that the heights of the hinge pin holes 40 and the coaming 32 are not always constant from car design to car design. Therefore, in order for the car set cover assembly 16 to be universally adaptable, the vertical distance between the hinge pin holes 40 and the upper lip 32 of the coaming 30 is used as a parameter in designing the hinge assembly 28 shown in the drawing.

The hinge assembly 28 includes a cover bracket 42 and one of a plurality of hinge eye plates 44, 46, 48, 50, 52. The cover bracket 42 is permanently riveted or otherwise fastened to the cover assembly 18, 20 and need not be removable from the cover assembly 18, 20 once the car set assembly 16 has been originally installed. Each of the hinge eye plates 44, 46, 48, 50, 52 includes a straight portion 54 having a pair of holes 56 therein through which the plate may be connected to the cover bracket, and an eye portion 58, 60, 62, 64, 66 having a diameter substantially equal to the diameter of the holes 40 in the hopper car hinge pin bracket 38 with which the hinge eye plates are designed to be employed. By this construction, a cover assembly 18, 20 of the proper width may be easily adapted to fit any of a plurality of hopper car constructions having different hinge pin-to-coaming distances and hinge pin diameters, by selecting the proper hinge eye plate to adapt the hatch cover segment to the hopper car design. Thus, no modification of the hatch cover segments 18, 20 themselves is required.

The cover bracket 42 is illustrated in FIG. 3 as including four holes 68 in a first segment 70 thereof for permitting attachment of the bracket 42 to the hatch cover assembly 18, 20 and a further pair of holes 72 in a second segment 74 thereof for permitting attachment of the bracket to one of the hinge eye plates 44, 46, 48, 50, 52. A pair of bolts 76 and lock nuts 78 are used to attach the plate to the bracket 42. Likewise, any other known fastening means may also be used. A hinge pin 80 extends through the hinge pin bracket holes 40 and through the hole of eye 58, 60, 62, 64, 66 in the hinge eye plate and is secured in place, e.g. by using a threaded pin and nut as the hinge pin 80. Once assembled, the car set assembly 16 permits the hatch cover assembly 18, 20 to be pivoted between closed positions such as that illustrated in FIGS. 1 and 2, and open positions in which material may be loaded into the hopper car.

The plurality of hinge eye plates 44, 46, 48, 50, 52 are shown in FIG. 4 relative to a cover bracket 42 on which each of the plates may be mounted. Each of the hinge plates includes a flat bracket connection surface 82 which defines a plane that may be used as a reference plane. The eye segment 58, 60, 62, 64, 66 of each plate includes a central axis which extends in a direction parallel to the reference plane of the plate and which is separated from the reference plane by a predetermined perpendicular distance that differs from the perpendicular distance included in each of the other illustrated plates.

Once it has been determined which of the hinge eye plates properly aligns a standard construction hatch cover with a hopper car to be fitted, a number of identical hinge eye plates of the proper construction are attached to the cover brackets 42 and the cover assembly 18, 20 is attached to the car. Thereafter, should it be determined that the improper hinge eye plates were employed or that the car set cover assembly 16 is to be modified to be used on a different hopper car, the only reconstruction necessary is the replacement of the hinge eye plates with a new set of properly-sized hinge eye plates for the required application.

Examples of various hopper car constructions employing different hinge pin-to-coaming separation distances are shown in FIG. 5. Two different hinge pin brackets 38, 38' are illustrated in the figure, and one of the brackets 38 is shown as including any one of a plurality of possible hinge pin heights relative to the coaming. In addition, although not illustrated in the figure, certain of these constructions may also employ a hinge pin hole 40 of a diameter larger or smaller than that shown, thus creating a requirement that a hinge eye plate for use with the construction be formed with an eye having a similarly sized diameter.

It is possible, through the use of the present invention, for a supplier of hatch covers to stock covers of a standard construction having a 20" or 24" width. In addition, by having a stock of each of the various sizes of hinge eye plates, which are inexpensive to stock, the entire range of common hopper car constructions may be serviced without the requirement of a large assortment of different large and expensive hatch covers. Thus, the cost of providing hatch covers to the industry is reduced from known hatch cover assemblies, and covers possessing the inventive system may be later retrofitted to cover a trough hatch of a hopper car having a construction different from the one for which it was originally assembled.

It is noted that although the invention has been described with reference to the above-preferred embodiment, alternatives and substitutes may be used and equivalents employed herein without departing from the scope of the invention as recited in the claims. For example, as mentioned above, it is possible to employ the invention in the locking device as well as the hinging system through the use of a cover hatch extending across the width of the hatch cover and having a pair of attachment holes on both sides of the cover. By providing such a cover bracket, not only the hinge eye plates may be adapted for use on hopper cars having different hinge pin-to-coaming distances, but the latch plate which is engaged by the locking device may be made replaceable as well. By this construction, a single standard hatch cover may be adapted for use with either of the conventional locking devices discussed above so as to permit an even greater capability of adaptation to different hopper car constructions.

What is claimed is:

1. A hinging system for pivotally connecting a first body member to a second body member about a pivot axis defined by the second body member, the system comprising:

a bracket;

means for connecting the bracket to the first body member;

a plurality of hinge eye plates each including a bracket connection surface reference plane and a single eye segment defining an opening having a central axis, the central axis of each of the plurality of hinge eye plates being displaced from the reference plane of that hinge eye plate by a distance different from the distance between the central axis and reference plane of each of the other hinge eye plates; and means for connecting the bracket connection surface of one of the hinge plates to the bracket and for connecting the eye segment of the one hinge eye plate to the second body member with the central axis of the eye segment aligned with the pivot axis.

2. The assembly according to claim 1, wherein said connecting means includes a plurality of bolts and nuts which permit the hinge eye plates to be removably attached to the bracket.

3. The assembly according to claim 2, wherein said connecting means further includes a hinge pin for connecting the eye segment of the one hinge eye plate to the second body member with the central axis of the eye segment aligned with the pivot axis.

4. The assembly according to claim 1, wherein said connecting means includes a hinge pin for connecting the eye segment of the one hinge eye plate to the second body member with the central axis of the eye segment aligned with the pivot axis.

5. For use in hopper cars each including, a top side having a trough hatch therein, coaming extending around the perimeter of the trough hatch, and at least ten hinge pin brackets attached to the top side of the hopper car and defining a pivot axis at one of the plurality of predetermined vertical heights relative to an upper edge of the coaming, a hatch cover assembly for adapting a hatch cover to be fastened to any one of a number of hopper cars, each of the hopper cars including hinge pin brackets disposed at a different one of the predetermined heights relative to the upper edge of the coaming, the assembly comprising:

a hatch cover movable to a position covering the trough hatch and including a cover bracket fixed thereto adjacent each hinge pin bracket; and a plurality of unique attachable hinge eye plates each of which, when attached to one of the cover brackets, is adapted to align with a hinge pin coaming when the hatch cover is moved to a position covering the trough hatch, the plurality of unique hinge eye plates permitting attachment of the hatch cover to hopper car trough hatches having hinge pin brackets of differing vertical heights relative to the coaming of the trough hatches.

6. The assembly according to claim 5, wherein each of the hinge eye plates includes a bracket connection surface defining a reference plane and an eye segment defining a single opening having a central axis, the central axis of each of the hinge eye plates being displaced from the reference plane of that hinge eye plate by a distance different from the distance between the central axis and reference plane of each of the other hinge eye plates.

7. The assembly according to claim 6, further comprising means for connecting the cover bracket to one of the hinge eye plates at the bracket connection surface of the hinge eye plate and for connecting the eye segment of the one hinge eye plate to the hinge pin bracket with the central axis of the eye segment aligned with the pivot axis defined by the second body member.

8. The assembly according to claim 7, wherein said connecting means includes a plurality of bolts and nuts which permit the hinge eye plates to be removably attached to the cover bracket.

9. The assembly according to claim 8 wherein said connecting means further includes a hinge pin for connecting the eye segment of the one hinge eye plate to the hinge pin bracket with the central axis of the eye segment aligned with the pivot axis.

10. The assembly according to claim 7, wherein said connecting means includes a hinge pin for connecting the eye segment of the one hinge eye plate to the hinge pin bracket with the central axis of the eye segment aligned with the pivot axis.

11. The assembly according to claim 5, wherein the hatch cover includes an inner surface and a resilient gasket attached to the inner surface, the gasket being adapted to align with the coaming of the hopper car on which the cover is to be fitted.

* * * * *